US007528701B2

(12) United States Patent
Adelman

(10) Patent No.: US 7,528,701 B2
(45) Date of Patent: May 5, 2009

(54) EFFICIENCY AUDIBLE ALARM

(76) Inventor: Roger A. Adelman, 957 Riverwatch Dr., Villa Hills, KY (US) 41017-3769

( * ) Notice: Subject to any disclaimer, the term of this patent is extended or adjusted under 35 U.S.C. 154(b) by 0 days.

(21) Appl. No.: 10/537,726

(22) PCT Filed: Dec. 2, 2003

(86) PCT No.: PCT/US03/38245

§ 371 (c)(1),
(2), (4) Date: Jun. 6, 2005

(87) PCT Pub. No.: WO2004/052075

PCT Pub. Date: Jun. 24, 2004

(65) Prior Publication Data

US 2006/0139153 A1 Jun. 29, 2006

Related U.S. Application Data

(60) Provisional application No. 60/431,560, filed on Dec. 6, 2002.

(51) Int. Cl.
*G08B 3/10* (2006.01)

(52) U.S. Cl. ..... 340/384.7; 340/388.4; 340/384.72

(58) Field of Classification Search ..... 340/384.1, 340/384.6, 384.72, 384.73, 388.4; 137/14, 137/111, 205; 381/61, 97, 98, 339, 340, 381/351

See application file for complete search history.

(56) References Cited

U.S. PATENT DOCUMENTS

| | | | | |
|---|---|---|---|---|
| 3,666,273 | A | 5/1972 | Kantola et al. | |
| 4,758,280 | A * | 7/1988 | Bergmann et al. | 106/286.4 |
| 4,785,280 | A | 11/1988 | Fubini et al. | |
| 5,540,248 | A | 7/1996 | Drzewiecki et al. | |
| 5,662,136 | A * | 9/1997 | Drzewiecki et al. | 137/14 |
| 5,664,020 | A * | 9/1997 | Goldfarb et al. | 381/89 |
| 6,327,221 | B1 * | 12/2001 | Gualtieri | 367/138 |
| 2005/0128058 | A1 * | 6/2005 | Oyagi et al. | 340/384.1 |
| 2006/0029241 | A1 * | 2/2006 | Graber | 381/182 |
| 2006/0045301 | A1 * | 3/2006 | Jakubaitis | 381/345 |

* cited by examiner

*Primary Examiner*—Benjamin C Lee
*Assistant Examiner*—Hoi C Lau
(74) *Attorney, Agent, or Firm*—Porter Wright Morris & Arthur LLP

(57) ABSTRACT

An audible alarm has first and second acoustic chambers that deliver sound to respective first and second horns. A phase adjustment circuit for delays the phase of sound generated in one of the two chambers so that sound emerging from the two horns is delivered with the same phase and same frequency, and emerging sound from the two horns is additive.

16 Claims, 6 Drawing Sheets

20
24
10
45
40
30
90
35
70
76
72
50
55
70'
50'
76'
72'
35'
45'
80

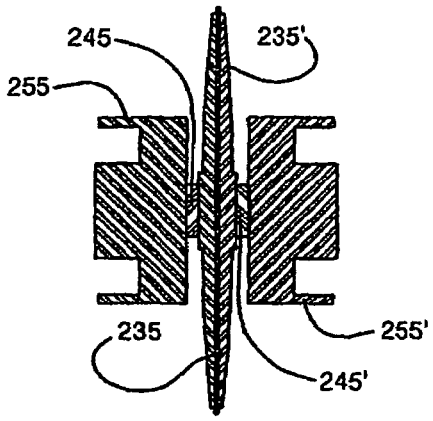
Fig. 2c
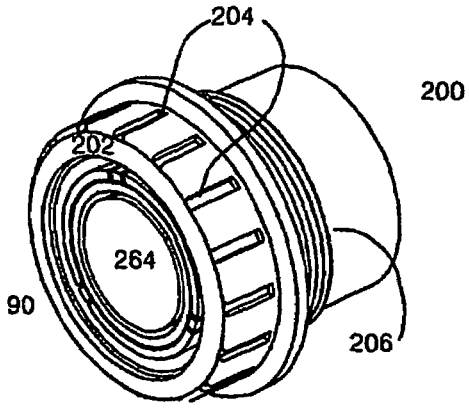
Fig. 2a
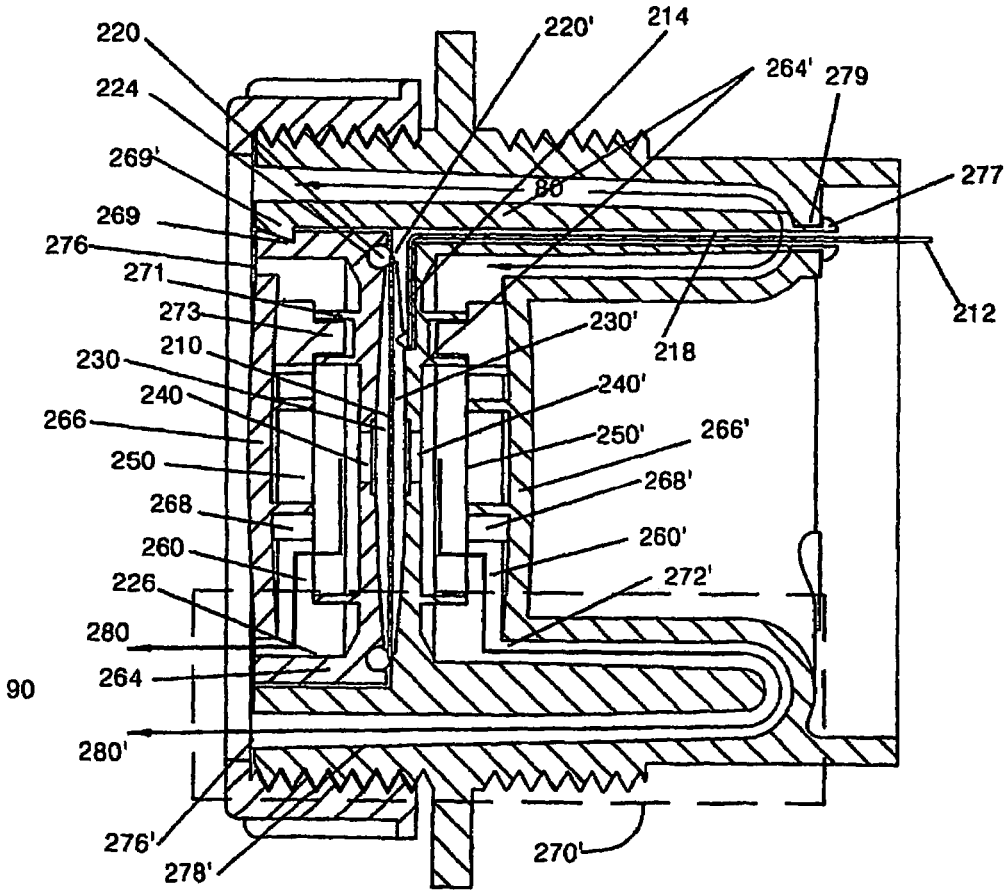
Fig. 2b
Fig. 2

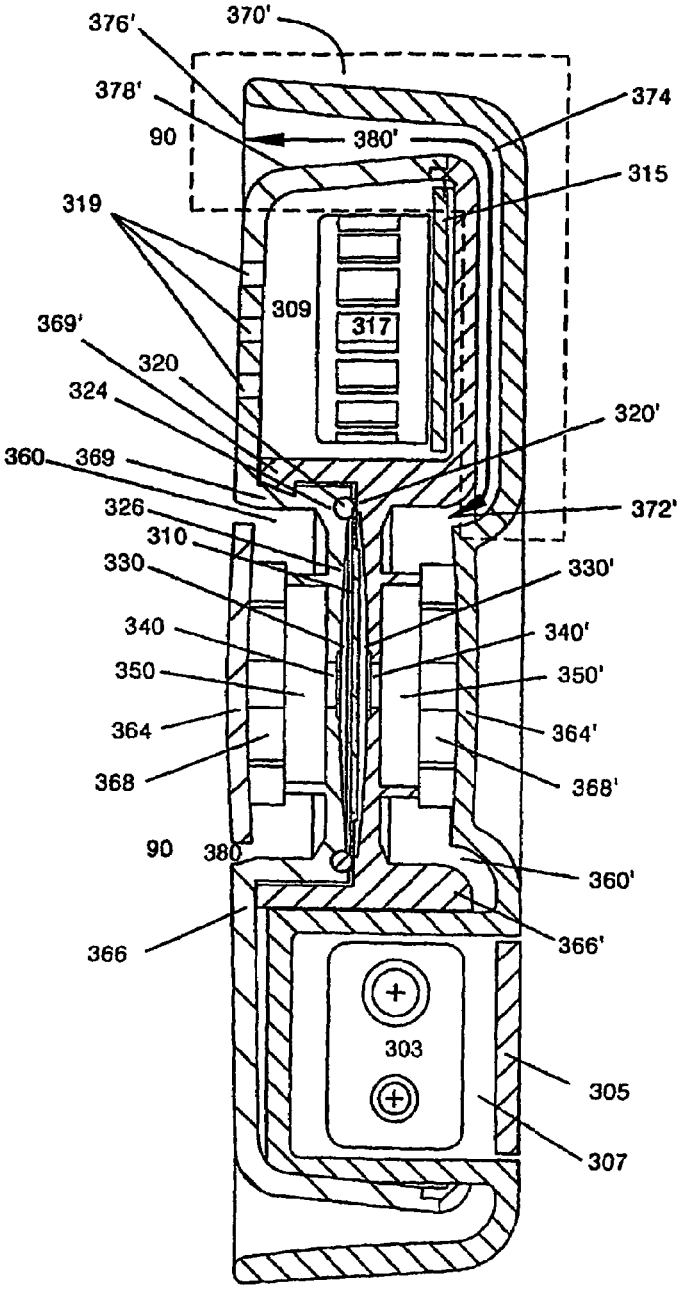
Fig. 3b
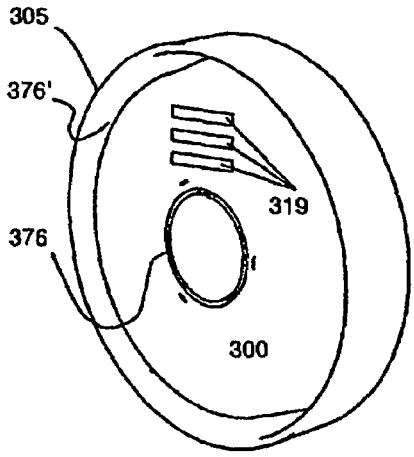
Fig. 3a
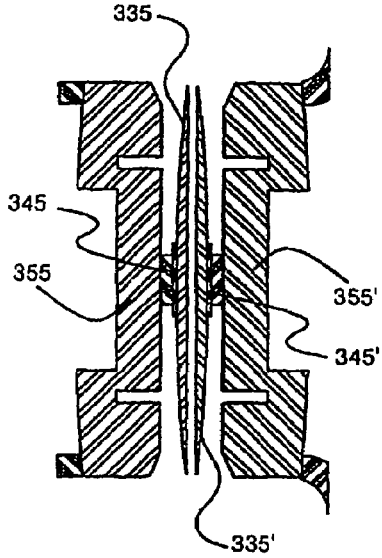
Fig. 3c
Fig. 3

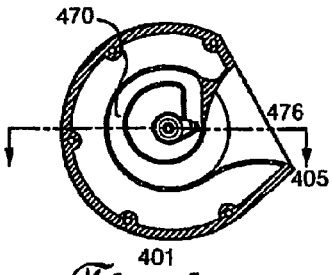
Fig. 4c
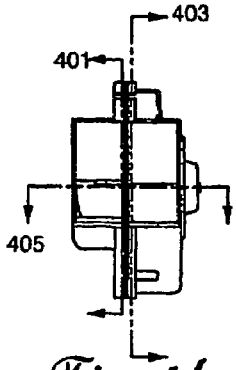
Fig. 4b
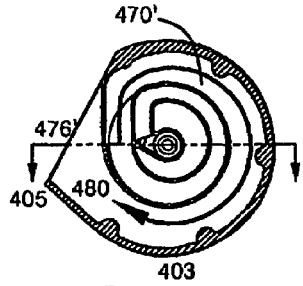
Fig. 4d
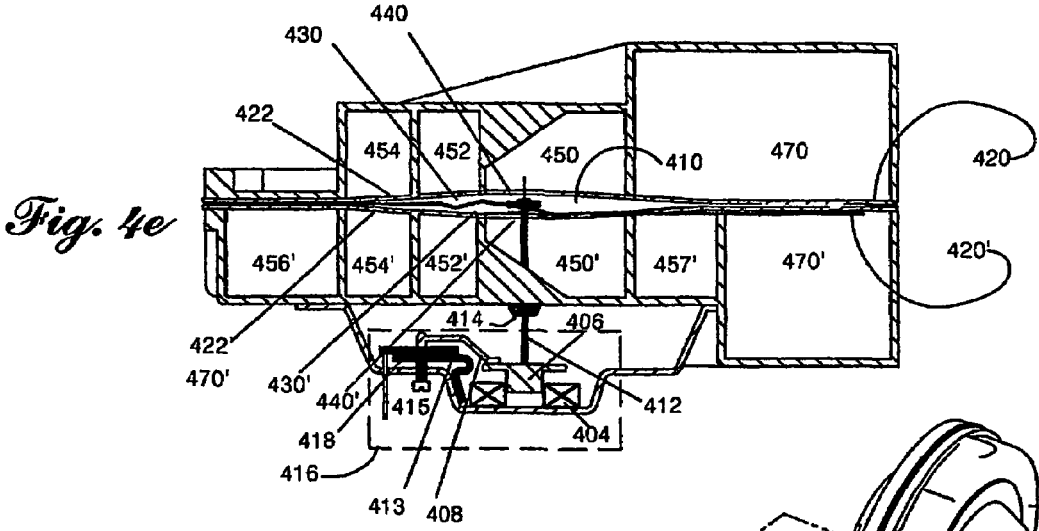
Fig. 4e
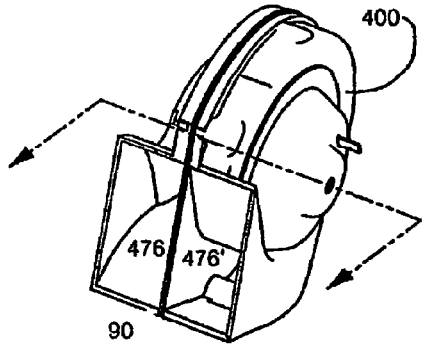
Fig. 4a
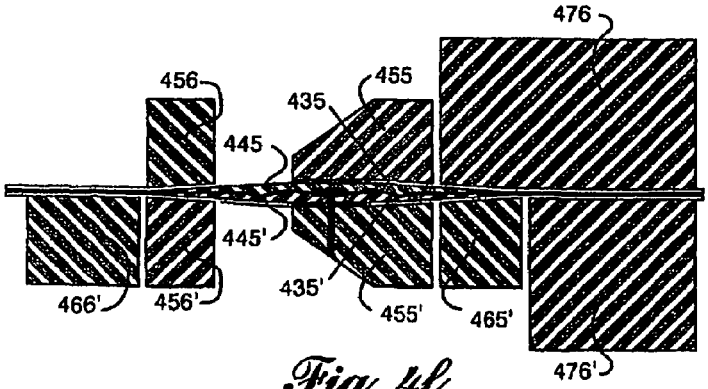
Fig 4f
Fig. 4

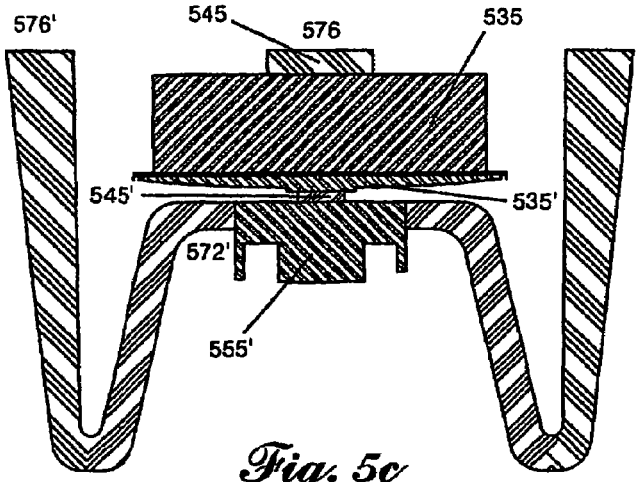
Fig. 5c
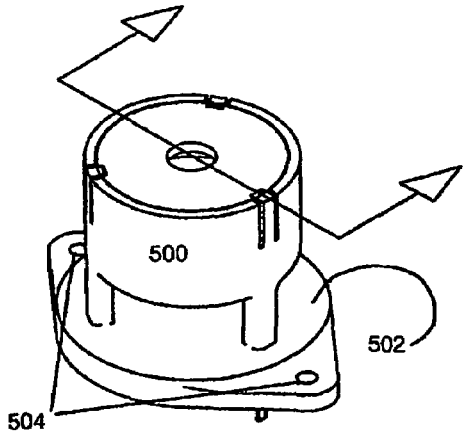
Fig. 5a
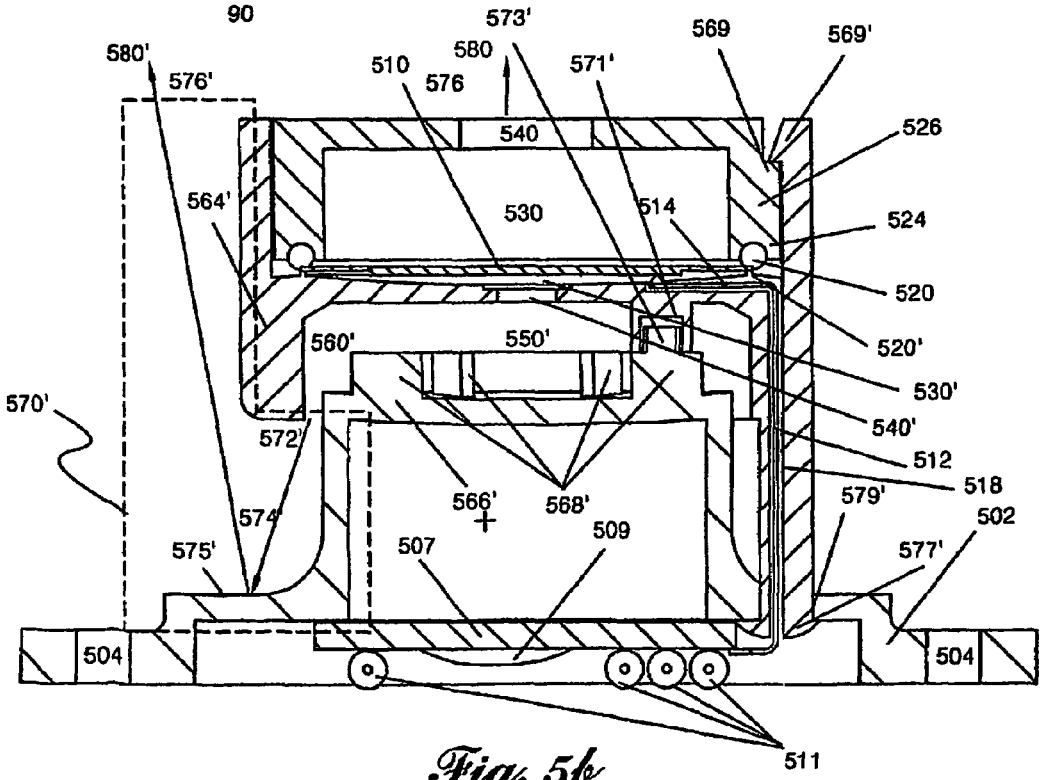
Fig. 5b
Fig. 5

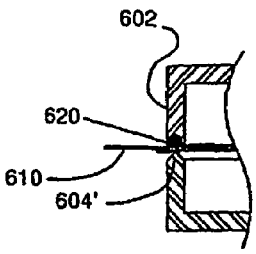
Fig. 6a
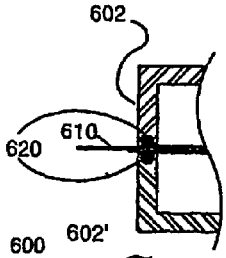
Fig. 6b
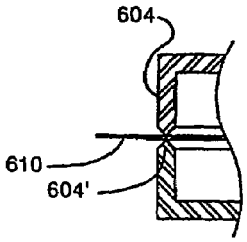
Fig. 6c
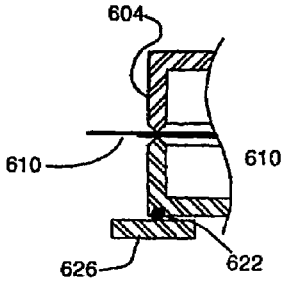
Fig. 6d
Fig. 6
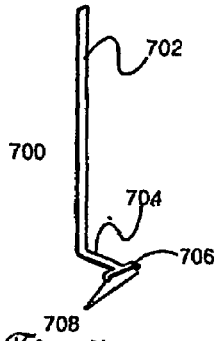
Fig. 7a
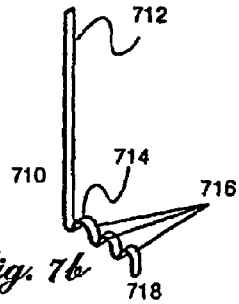
Fig. 7b
Fig. 7
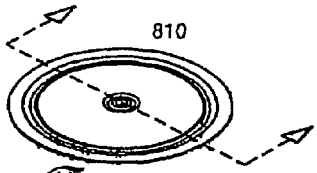
Fig. 8a
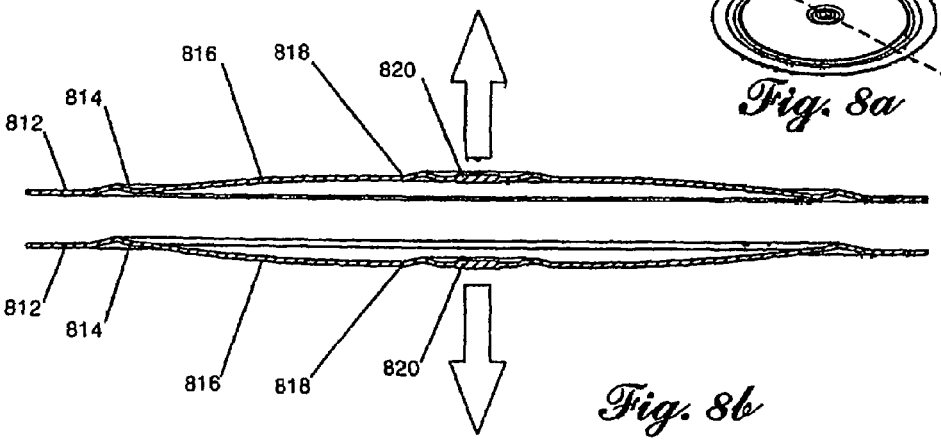
Fig. 8b
Fig. 8

EFFICIENCY AUDIBLE ALARM

RELATED APPLICATION

This application claims priority to Provisional Application Ser. No. 60/431,560, filed Dec. 6, 2002 entitled Improved Efficiency Audible Alarm.

BACKGROUND

The present invention relates to the field of audible alarm devices in general, and in particular to that class of audible alarms that utilizes a driven vibrating member in conjunction with a resonance chamber to produce a loud sound roughly at a system resonant frequency and/or its multiples. The disclosed invention provides a general method for significantly improving the efficiency of sound production of such audible alarms, and it demonstrates several means for achieving such energy efficiency through example devices whose shape, structure and construction enable the realization of the method.

The audible alarm is one of the most ubiquitous of all devices, and its manifestations range widely from the "clang" of a church bell to the "shriek" sound of a siren to the "click" sound of a tactile keyboard switch. It is a fundamental objective of all audible alarms to provide the loudest, most recognizable sound possible; it is also desirable to produce such sound with the lowest possible expenditure of energy, i.e. to function efficiently.

One very large class of audible alarms, herein referred to as a "plate and chamber" alarm, is characterized by a mechanical, vibration "plate" which works in companion with an acoustic resonance "chamber". These alarms commonly find application in such familiar devices as smoke detectors and/or carbon monoxide detectors, open door enunciators, vehicle backup warning devices, and automotive horns. Such alarms often use battery power as their primary or backup source of power, and the amount of available energy stored in the battery can be a limiting factor for the overall performance of the alarm. In battery-powered alarms in particular, it is highly desirable to convert the input power available to the alarm into the maximum amount of acoustic output power, i.e., for the alarm to be as energy efficient as possible. Thus it is highly desirable to obtain increased acoustic efficiency, either as an increase in loudness, a decrease in power, or a combination of both.

SUMMARY OF THE INVENTION

The present invention describes a novel method for effectively doubling of the sound producing efficiency in fixed and multiple harmonic frequency types of plate and chamber and similar alarms, and it demonstrates practical means for achieving this improvement.

In a plate and chamber alarm, a disk or plate is caused to vibrate at a frequency in the audible range, and most commonly in the range 200 Hz to 4000 Hz. Vibration of the plate is typically produced by an electrical excitation means, usually piezoelectric or electromagnetic in nature; less typically the vibration of the plate is produced by other means such as air, mechanical, or hydraulic actuation. In many of the variations of this class of alarm, the plate forms one side or wall of the acoustic chamber. Within the chamber, the vibrations of the plate are transferred to the air inside the chamber, and by means of familiar acoustic actions, the vibrating air in the chamber is caused to vibrate in sympathy with the driving plate to form a resonant system. Such resonance action greatly improves the ability of the vibrating plate to transfer its vibrations to create a strong, airborne acoustic signal. In certain applications, an impedance-matching acoustic horn, and/or other resonance enhancing or stabilization chambers and/or conduits also may be used in conjunction with the chamber to further improve the communication of acoustic energy to the surrounding air. The design of any specific vibrating plate and the acoustic chambers can be obtained using well-known design methods, and both classical acoustics and modern computational methods, e.g. finite element analysis (FEA) have been applied to these design problems. Typical devices are usually the result of both analytical design and empirical developmental work, and the devices described herein are the result of such combined methods.

It is a primary objective of the present invention to provide a method for significantly improving the acoustic efficiency of a plate and chamber type of audible alarm by utilizing the vibrations that exist on both sides of the vibrating plate in a way that constructively combines the sounds so generated by both surfaces. Such constructive combination of sound is achieved by the addition of an acoustic pathway or pathways which first isolate sound generated in the resonating chambers from one another and then provide a differential acoustic delay such that the originally out of phase sounds combine together at the free air exit of each pathway in an additive fashion.

It is theoretically necessary for such additive combination to occur when the front side and backside conduits are caused to differ in their effective acoustic lengths by one half wavelength of the sound at the generating frequency of the vibrating plate. A practical device is possible, however, even if the actual effective path lengths differ only approximately one half wavelength. Constructive addition will occur whenever the pathways differ by more than one fourth of a wavelength and less than three fourths of a wavelength or any integral number of wavelengths plus this range of variability. The amount of loss of efficient combination is in fact quite small for even moderate variations from the ideal half wavelength. Degradation of the combinatorial effect varies as a cosine function, and for a device whose change in path length is as much as thirty per cent longer or shorter than the ideal length, the efficiency will be decreased from the ideal doubling by only about ten per cent. It is, therefore, relatively easy to achieve a very effective practical device for doubling or nearly doubling of the sound producing efficiency. There are, as a consequence of the available latitude in length of the delay means, many forms of the device of the present invention that can be produced effectively even when manufacturing tolerances are significantly relaxed or when it is necessary because of space limitations to create delay conduits with non-ideal lengths.

Furthermore, the notion of a delay conduit is a somewhat oversimplified, albeit accurate, way for accomplishing the required phase matching of the signals. In reality, the behavior of sound is quite complex, especially when considering its behavior within geometries whose dimensions are less than one wavelength. Because of the actual properties of sound, it is possible to construct structures whose geometrical effects on dispersion and diffraction also contribute to achieving the desired phase matching capability. Such alternative solutions are frequently found by trial and error methods "at the bench." More recently, however, finite element analysis (FEA) has become a practical way to find such solutions. Present day FEA, performed on a reasonably powerful personal computer, can provide an analytical description of the behavior of sound that has simply not achievable using more traditional "lumped parameter" methods for acoustic analysis.

While there is great permissible latitude in the lengths of the conduits used to cause the constructive summation of the front and back generated sounds, it is an extremely important consideration of the present invention that its fundamental airborne sound producing structure is such that all of its parts are optimally chosen to support resonance at one or a small number of distinct frequencies. The so-designed alarm is specifically not intended to operate over a large frequency band, as would be the case, for instance, with audio speakers. The front and back chambers of the present invention, as well as the vibrating plate are all chosen with physical characteristics such that the sound is produced most efficiently, i.e. at the system resonance(s).

Such efficiency thus permits any of the attributes loudness, size, or power consumption to be optimized individually or collectively for a particular application while permitting very large tolerances for variability in manufactured devices.

This simple utilization of the heretofore "-unused" vibration surface on the backside of the vibrating member then permits a variety of application alternatives, particularly in the way that the sound phase-matching means are constructed. It is easily demonstrated that when the construction of the device is such that the original sound chamber and vibrating plate are caused to remain unchanged, the addition of a secondary resonating chamber and a precise phase matching means will result in a 6 dB increase in the output sound pressure level (SPL), i.e. a doubling of the sound energy output.

BRIEF DESCRIPTION OF THE DRAWINGS

The accompanying drawings incorporated in and forming a part of the specification illustrate several aspects of the present invention, and together with the description, they serve to explain the principles of the invention. In the drawings:

FIGS. 2*a*-2*c* depict a preferred embodiment of the present invention wherein the secondary conduit is fashioned in the form of an axially folded horn such as might exist, for example, in a general-purpose piezo whistle.

FIGS. 3*a*-3*c* depict a preferred embodiment of the present invention wherein the secondary conduit is fashioned in the form of a radially extended horn whose terminal "bell" forms an annulus at right angles to its radial portion such as might exist, for example, in a smoke or carbon monoxide detector.

FIGS. 4*a*-4*c* depict a preferred embodiment of the present invention wherein the secondary conduit is fashioned in the form an additional turn on a spiral horn such as might exist, for example, in an electromagnetic automotive horn.

FIGS. 5*a*-5*c* depict a preferred embodiment of the present invention as a general purpose piezo whistle wherein the backside sound generation is formed by means of resonance chambers and conduits which are not mirrors of the front side chambers and conduits and wherein the phase matching of the front side and back side sounds is accomplished by elements which are not necessarily exactly one-half wavelength delay conduits.

FIGS. 6*a*-6*d* depict details of practical means for constraining a vibrating plate in the present invention.

FIGS. 7*a* and 7*b* depict useful configuration details for electrical contact elements used with piezo-electric sound generating elements FIGS. 8*a* and 8*b* depict a sound generating plate means for producing very energetic "click" sounds.

DETAILED DESCRIPTION OF THE PREFERRED EMBODIMENTS

Figures 1, 1A, 1B, 1C, 1D, 1E, 1F, 1G, 1H:
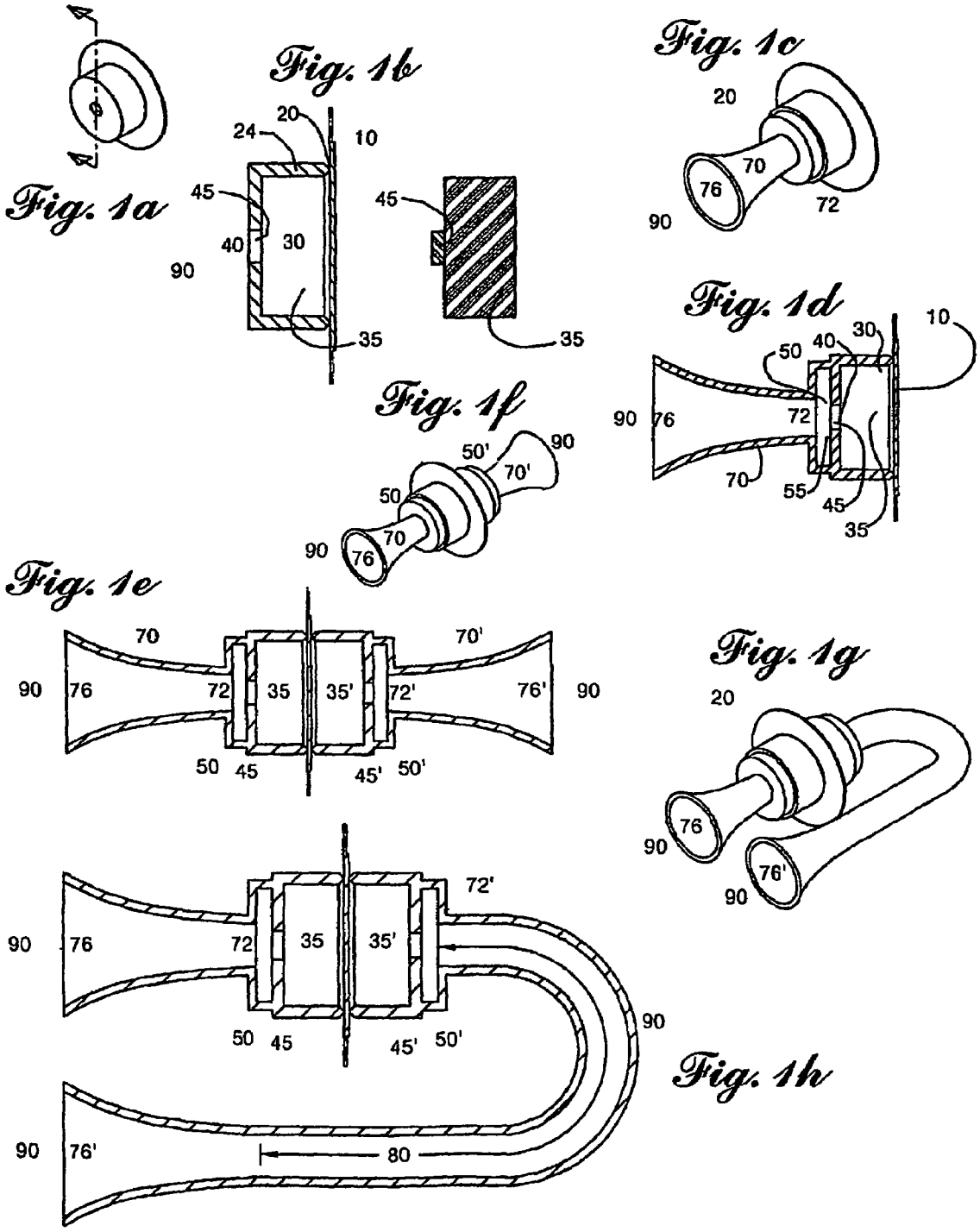
FIGS. 1*a*-1*h* depict diagrammatically how a common plate and chamber alarm functions and how underlying principle of the present invention extends the sound generating output power without requiring additional input power.

Referring now to the drawings, FIG. 1 depicts a progression of illustrative structures that demonstrate the theoretical basis for the invention. The particular aspects of the structures may be realized, of course, by geometries of different, equivalent constructions, e.g. a square instead of a circular boundary, or a magnetic instead of a piezoelectric drive, and the depictions of the FIGs must not be taken as limiting but rather simply a convenience for illustrating the principles in the invention.

Accordingly, FIG. 1*a* depicts the simple plate and chamber system which is further shown in cross section in FIG. 1*b*, and which comprises a transducer element 10 in intimate contact with a support feature 20 corresponding either to an edge or other vibration "node" of transducer element 10, said support feature then being extended to form a chamber wall 24 of resonance chamber 30 where the vibration of the transducer element 10 causes the springy air 35 (also more clearly depicted isolated alongside the structure as a hatched block) in the chamber 30 to be sympathetically excited. An output port 40, typically consisting of a hole with or without interposed grillwork, is usually placed in the bottom of the chamber opposite the transducer element. Mass air 45 inside the output port 40 is excited in concert with the springy air 35 inside the chamber 40 to resonate in a similar manner to that entity known as a "Helmholtz resonator" at a resonant frequency which depends, at constant temperature, pressure, and humidity, upon the mass and spring properties of the included air. Sound emanates from the output port 40 to provide the alarm signal to the free air 90 of the environment. A variety of methods for electrically driving the transducer element 10 are well known, and the electrical attachment is typically connected to the side of the transducer element that does not form a boundary of the resonance chamber. Sound generated by the means demonstrated in FIG. 1*a* is most efficiently generated when the driving frequency of transducer element 10 is caused to equal the resonant frequency of the sound system comprising the resonance chamber 30, its springy air 35, the output port 40, and the mass air 45. To a somewhat lesser degree, the sound of the system also is more efficiently generated when the driving frequency of the transducer element 10 is identically caused to be equal to the resonance of the element 10 as well as identically equal to the resonant frequency of the resonance chamber system.

In the structure depicted by FIG. 1*b*, there can be a significant loss in energy transfer at the output port 40 to free-air 90 interfaces, and there can as well be a susceptibility to interference with the air mass 45 at the output port 40 which can disrupt the resonating system. FIG. 1*c* extends the sound generating concept toward providing a more stable resonance and more efficient coupling to the surrounding free air 90 by the addition of transition chamber 50 and a transformer horn 70 as shown in FIG. 1*c*. FIG. 1*d* is further illustrative of a longitudinal cross section of the depiction of FIG. 1*c*, and in FIG. 1*d*, transition chamber 50 provides for a secondary springy air mass 55 to be captured within secondary chamber walls and between output port 40 and secondary output port which is shown as throat 72 of the transformer horn 70. When a difference in acoustic impedance exists between the throat 72 and at the mouth 76 of the transformer horn 70, the transitional nature of the transformer horn serves to correct for such impedance mismatches between air in the horn and the ultimate impedance of the surrounding free air 90. Such stabilizing and coupling means are readily and economically producible using conventional production methods such as injection molding and stamping, and they may be incorporated into the simpler structures of FIG. 1*a* in many instances. The details shown in FIGS. 1*c* and 1*d* demonstrate the most complete description of such a stabilized and well-coupled system.

While FIGS. 1*c* and 1*d* provide an optimal acoustic arrangement for a plate and chamber sound generating system operating at the resonant frequency of its elements, FIGS. 1*e* and 1*f* show that there is no limitation upon placing an identical back resonating chamber 30' and back transition horn 70' upon the backside of transducer element 10. Clearly the sound output from the back mouth 76' of back transition horn 30' is equivalent to the sound output from the mouth 76 of horn 70 in its loudness and its frequency content. Just as clearly, the sound generated by the backside of transducer element 10 is also 180 degrees out of phase with sound generated by its front surface. With the two sounds being generated exactly out of phase, there will be cancellation, especially to the sides of a sound system so constructed.

To avoid such sound cancellation, FIGS. 1*g* and 1*h* depict the same system as FIGS. 1*e* and 1*f*, except that a delay means 80 has been added to the structure. Delay means 80 is exactly one half wavelength of sound long, and sound at the end of its path is exactly 180 degrees lagging the sound at its input. In this way, the sound that emanates from the back mouth 76' of back horn 70' is exactly in phase with the sound that emanates from the mouth 76 of horn 70. As a result, the sound generated into the surrounding air by the system of FIG. 1*d*, is exactly twice as loud, or of 6 dB greater sound pressure level, than is the sound emanated by the similar half system originally presented in FIGS. 1*c* and 1*d*.

FIG. 2*a* shows a perspective of the configuration of the present invention as a general purpose piezoelectric whistle 200 which has a convenient single mounting nut 202 with serrations 204 for mounting the whistle 200 in a panel with a single hole, the mounting nut 202 shown in a front mount position, and rear threads 206 are provided for an alternative back mounting position FIG. 2*b* shows a cross-sectional view of general purpose piezoelectric whistle 200 illustrative of the general concepts presented in FIG. 1, and in particular demonstrating delay means 80 as a "folded horn 270' for sound path 280' in the present figure which is longer than sound path 280 by one half wavelength of the resonant sound frequency of the device. This general purpose piezoelectric whistle 200 device is comprised of a central piezoelectric transducer element 210 in intimate contact with a stiffly compliant front support feature 220 shown as an O-ring in a groove feature 224, and a non-compliant back support feature 220' corresponding either to an edge support of transducer element 210. In order to maintain transducer element 210 in its side-to-side (centered) position in relationship to resonance chamber 230, edge-contacting pillars (not shown) are placed at a regular intervals around its periphery with a very small gap distance between their perpendicular contacting line and the peripheral edge of central piezoelectric transducer element 210. Such centering pillars serve to keep the plate from any significant drifting out of position with respect to the chamber; for a circular chamber and plate, they serve to maintain concentricity between the two elements.

The groove feature 224 of front support feature 220 is extended to form a chamber wall 226 of the front thin resonance chamber 230 where the vibration of the transducer element 210 causes the springy air 235 (also more clearly depicted isolated alongside the structure as a hatched air block of FIG. 2*c*) in the front thin resonance chamber 230 to be sympathetically excited. A mirror of the front side structure of the device is also shown and is comprised of a back thin resonance chamber 230' having a back chamber wall formed by back support feature 220' which is shown in communication with the back surface of transducer element 210 and containing back springy air 235'.

A front output port 240 is shown as a hole placed in the front wall of the front thin resonance chamber 230 opposite piezoelectric transducer element 210. Mass air 245 inside the output port 240 is excited in concert with the springy air 235 inside the chamber 240 to resonate at a resonant frequency which depends, at constant temperature, pressure, and humidity, upon the mass and spring properties of the included air. Further, in mirror fashion to the front output port 240, a back output port 240' is shown in the back wall of the back thin resonance chamber 230' opposite piezoelectric transducer element 210. Mass air 245' inside the back output port 240' is excited in concert with the springy air 235 inside the chamber 240 to resonate at a back generated resonant frequency identical to, but 180 degrees out of phase with, resonant frequency of the front thin resonance chamber 230.

Contiguous with front output port 240 is transition chamber 250 which encloses a secondary springy air mass 255 to be captured within secondary chamber walls and between output port 240 and secondary output port 260. Secondary output port 260 is not a simple hole, but is rather formed by a gap between the front sound cap 266 and the front structural cup 264 and certain minor support legs 268 such as appear in section and partial section in FIG. 2*c*. Front structural cup 264 further includes the surfaces that form the outer wall of the resonance chamber 230 and the inner and sidewalls of transition chamber 250. A recess holding mechanism 269 is depicted as a recess for its mating part. The air in the output secondary port 260 is contiguous with air of the transformer horn 270, which is very short in the present illustration. The horn is in contact with surrounding free air 90.

Similarly, contiguous with back output port 240' is back transition chamber 250' which encloses a secondary springy air mass 255' to be captured within secondary chamber walls and between back output port 240' and back secondary output port 260'. Back secondary output port 260' is not a simple hole, but is rather formed by a gap between the back structural sound cap 266' and the back horn housing cup 264' and certain minor support legs 268' such as appear in section and partial section in FIG. 2*c*. Back horn housing cup 264' further includes surfaces which form the outer wall of the resonance chamber 230' and the inner and sidewalls of back transition chamber 250'. A companion barb holding mechanism 269' is depicted as a barb for its mating feature, recess holding mechanism 269. The air in the back output secondary port 260' is contiguous with air in the throat 272' of the back transformer horn 270', and the transformer horn includes additional length component 280 which corresponds at least approximately to one-half wavelength of the sound frequency of the device at resonance. The mouth 276' of transformer horn is in contact with surrounding free air 90. The throat 272' and the mouth 276' are connected by the transitional 278' walls of the transformer horn 270', which serve to correct for such impedance mismatches as exists between the output of the secondary resonance chamber and surrounding free air 90.

In the particular device of FIG. 2*b*, the various cross sectional conduits represent annular functional elements. Similarly the various connections between components such as the barb and recess holding mechanism 269' and 269; the cylinder 271 and star post 273 mechanism; and the stake 277 and socket 279 are present at intervals around the various annular placements in the assembly of general purpose piezoelectric whistle 200.

A variety of methods for electrically driving the transducer element 210 are well known, and in the present device, the electrical contact with the piezoelectric transducer element 210 is achieved by spring contactors 212 shown as cantilever extensions 214 of the spring contactors 212 proper which extend through contactor tunnels 218 passing from the chamber floor where it exists as a depression to the outer most margin of the structure of general purpose piezoelectric whistle 200 to be attached to an electrical driving circuit and power supply (neither of which is shown) external to the whistle structure.

FIG. 3*a* shows a perspective of the configuration of the present invention as a smoke or carbon monoxide detector-housed-whistle 300 which has an outer annulus 305 which may have typical wall mounting holes and battery receptacle (not shown) which are well-known and which have their design specified to a great extent by certain safety standards such as UL 217 or UL 2034.

FIG. 3*b* shows a cross-sectional view of detector-housed-whistle 300 illustrative of the general concepts presented in FIG. 1, and in particular demonstrating delay means 80 as a "radial turned horn" 370' for sound path 380' in the present figure which is longer than sound path 380 by one half wavelength of the resonant sound frequency of the device. This detector-housed-whistle 300 device is comprised of a central piezoelectric transducer element 310 in intimate contact with a stiffly compliant front support feature 320 shown as an O-ring in a groove feature 324, and a non-compliant back support feature 320' corresponding either to an edge support of transducer element 310. In order to maintain transducer element 310 in its side-to-side (centered) position in relationship to resonance chamber 330, edge-contacting pillars (not shown) are placed at a regular intervals around its periphery with a very small gap distance between their perpendicular contacting line and the peripheral edge of central piezoelectric transducer element 310.

The groove feature 324 of front support feature 320 is extended to form a chamber wall 326 of the front thin resonance chamber 330 where the vibration of the transducer element 310 causes the springy air 335 (also more clearly depicted isolated alongside the structure as a hatched air block of FIG. 3*c*) in the front thin resonance chamber 330 to be sympathetically excited. A mirror of the front side structure of the device is also shown and is comprised of a back thin resonance chamber 330', having a back chamber wall formed by back support feature 320' is shown in communication with the back surface of transducer element 310 and containing back springy air 335'.

A front output port 340 is shown as a hole placed in the front wall of the front thin resonance chamber 330 opposite piezoelectric transducer element 310. Mass air 345 inside the output port 340 is excited in concert with the springy air 335 inside the chamber 340 to resonate at a resonant frequency which depends, at constant temperature, pressure, and humidity, upon the mass and spring properties of the included air. Further in mirror fashion to the front output port 340, a back output port 340', is shown in the back wall of the back thin resonance chamber 330' opposite piezoelectric transducer element 310. Mass air 345' inside the back output port 340' is excited in concert with the springy air 335' inside the chamber 340' to resonate at a back generated resonant frequency identical to, but 180 degrees out of phase with, resonant frequency of the front thin resonance chamber 330.

Contiguous with front output port 340 is transition chamber 350 which encloses a secondary springy air mass 355 to be captured within secondary chamber walls and between output port 340 and secondary output port 360. Secondary output port 360 is not a simple hole, but is rather formed by a gap between the front sound cap 364 and the front structural cup 366 as appear in section and partial section in FIG. 3*c*. Front structural cup 366 further includes the surfaces, which form the outer wall of the resonance chamber 330 and the inner and sidewalls of transition chamber 350. A recess holding mechanism 369 is depicted as a recess for its mating part. The air in the front output secondary port is contiguous with air of the front transformer horn, both of which are very short and shown simply combined as sound path 380 in the present illustration. The horn is in contact with surrounding free air 90.

Similarly, contiguous with back output port 340' is back transition chamber 350' which encloses a secondary springy air mass 355' to be captured within secondary chamber walls and between back output port 340' and back secondary output port 360'. Back secondary output port 360' is not a simple hole, but is rather formed by a gap between the back structural sound cap 364' and the back horn housing cup 366' and certain minor support legs 368' such as appear in section and partial section in FIG. 3*c*. Back horn housing cup 366' further includes surfaces which form the outer wall of the resonance chamber 330' and the inner and sidewalls of back transition chamber 350'. A companion barb holding mechanism 369' is depicted as a barb for its mating feature, recess holding mechanism 369. The air in the back output secondary port 360' is contiguous with air in the throat 372' of the back radial bent transformer horn 370', and the transformer horn includes additional length component 380 which corresponds at least approximately to one-half wavelength of the sound frequency of the device at resonance. The mouth 376' of back radial bent transformer horn points in an axial direction because of radial bend 374', and air in the mouth 376' is in contact with surrounding free air 90. The throat 372' and the mouth 376' are connected by the transitional 378' walls of the transformer horn 370', which serve to correct for such impedance mismatches as exists between the output of the secondary resonance chamber and surrounding free air 90.

In the particular device of FIG. 3*b*, the various cross sectional conduits represent bent radial functional elements consistent with the shape of a smoke or carbon monoxide detector. There are various connections between components such as the barb and recess holding mechanism 369' and 369 which are particular to structures for such applications. Similarly, a battery 303, in a battery well 305 having a battery cover 307, which typically would include a lockout mechanism (not shown), also is presented for completeness of the disclosure. The region 309 inside of front structural cup 366 and back horn housing cup 366' provides room for a populated circuit board 315 and a detection element 317 also common to these applications. A variety of methods for electrically driving the transducer element 310 are well known, and in the present device, the means for making electrical contact between the piezoelectric transducer element 310 and the driving electronics of populated circuit board 315 is accomplished by either soldered wiring or spring contactors (neither of which is shown in FIG. 3) whose fixed portions are external to the whistle structure. Ventilation means 319, consistent with smoke detector and/or CO detector function, are provided for the free entry of air into the sensing area of the device.

FIG. 4*a* shows a perspective of the configuration of the present invention as a vehicle audible alarm 400, which is typified by its pronounced horn structure. Audio alarms of this type may have a variety of mounting features, which are well known to designers skilled in this art, and the embodiment presented herein, while not showing any such mountings, poses no new limitations on them.

FIG. 4*b* shows an end view of vehicle audible alarm 400, and it identifies the location of several sectioning lines 401, 403, and 405 whose corresponding section views as FIGS. 4*c*, 4*d*, and 4*e* respectively further clarify the internal structure of the embodiment. FIGS. 4*c* and 4*d* are illustrative of the concepts presented in particular in delay means 80 in FIG. 1*h*, with such delay being accomplished as the difference in length of a front spiral horn 470, and a back spiral horn 470'. Sound path delay 480 corresponds to a length of one half wavelength of the resonant sound of vehicle audible alarm 400.

FIG. 4*e* further shows, in cross section, the operational features of vehicle audible alarm 400 comprising a central bi-stable plate transducer element 410 in intimate contact with a front support feature 420, and back support feature 420', which together comprise a fixed edge support of transducer element 410. Other accessories, not shown, include appropriate gaskets and holding fasteners to seal and fix the assembly firmly on the periphery of central bi-stable plate transducer element 410. A connecting rod 412 passing through a rod seal 414 connects the central bi-stable plate transducer element 410 to the electromagnetic drive motor 416.

A front thin resonance chamber 430 formed by the boundary the central bi-stable plate transducer element 410 and front chamber wall 422 contains springy air 435, which also is more clearly depicted as a cross hatched portion in FIG. 4*c*. A mirror of the front side structure of the device is similarly comprised of a back thin resonance chamber 430', formed by the boundary the central bi-stable plate transducer element 410 and back chamber wall 422' contains the back springy air 435', which also is more clearly depicted as a cross hatched portion in FIG. 4*c*.

A front output port 440 is shown as a hole placed in the front wall of the front thin resonance chamber 430 opposite central bi-stable plate transducer element 410. Mass air 445 inside the output port 440 is in communication on one side with the springy air 435 inside the chamber 430 and on its opposite side it is in contact with air in resonance chamber 450. Further, in mirror fashion to the front output port 440, a back output port 440', is shown in the back wall of the back thin resonance chamber 430' opposite central bi-stable plate transducer element 410. Mass air 445' inside the back output port 440' is excited in concert with the back springy air 435' inside the chamber 430' and on its opposite side it is in contact with air in back resonance chamber 450.'

The throat air 455 in resonance chambers 450 is in direct communication with front horn air which extends within spiral horn 470 from its throat 472 to its mouth 476. Similarly, in mirror fashion, the throat air 455' in resonance chamber 450' is in direct communication with back horn air 475' which extends within back spiral horn 470' from its throat 472' to its mouth 476'. Air at the mouths of both horns is in contact with surrounding free air 90.

The various shapes of the chamber and horn elements are selected such that their collective physical construction is consistent with the containment of such volumes and masses of contained air to cause it to resonate at a resonant frequency which depends, at constant temperature, pressure, and humidity, upon the mass and spring properties of the included air.

The details of the electromagnetic drive for the central bi-stable plate transducer element 410 are generally well known, and are represented in the present device as an electromagnetic coil 404 surrounding magnetopermeable slug 406 which is further connected to drive rod 412. Also affixed to drive rod 412 is switch actuator 408, which is in intermittent contact with switch 418. A leaf spring 413 and a setscrew 415 further provide adjustment features to tuning capability to effect periodic timing of electromagnetic drive.

FIG. 5*a* shows a perspective of the configuration of the present invention as a practical, general purpose piezoelectric whistle 500 which has a mounting base 502 with serrations two screw mounting holes 504 for mounting the whistle 500 to a panel or similar basic structure. This embodiment serves to show that means for generating the backside sound resonance and for obtaining a phase matching of the backside sound with that of the front need not be an exactly one half wavelength long conduit.

FIG. 5*b* shows a cross-sectional view of general purpose piezoelectric whistle 500 illustrative of the general concepts presented in FIG. 1, and in particular demonstrating delay means 80 as a reflective open horn 570' for sound path 580' in the present figure is different from sound path 580, but not necessarily longer by one half wavelength of the resonant sound frequency of the device. This general purpose piezoelectric whistle 500 device is comprised of a central piezoelectric transducer element 510 in intimate contact with a stiffly compliant front support feature 520 shown as an O-ring in a groove feature 524, and a non-compliant back support feature 520' corresponding either to an edge support of transducer element 510. Small, line contact, centering pillars (not shown) extending from non-compliant rear support feature 520' are placed at regular intervals around its periphery with a very small gap distance between their line contact and the peripheral edge of central piezoelectric transducer element 510.

The groove feature 524 of front support feature 520 is extended to form a chamber wall 526 of the front resonance chamber 530 where the vibration of the transducer element 510 causes the springy air 535, also more clearly depicted isolated alongside the structure as a hatched air block of FIG. 5*c*, in the front thin resonance chamber 530 to be sympathetically excited. A front output port 540 is shown as a hole placed in the front wall of the front thin resonance chamber 530 opposite piezoelectric transducer element 510. Mass air 545 inside the output port 540 is excited in concert with the springy air 535 inside the chamber 540 to resonate at a resonant frequency which depends, at constant temperature, pressure, and humidity, upon the mass and spring properties of the included air. The front chamber in its entirety constitutes a good approximation to a Helmholtz resonator, i.e. an acoustic device which, like a jug, creates a resonance with the air in the neck acting like a mass and the air in the body of the bottle acting like a spring.

On the other side of piezoelectric transducer element 510 a backside structure of the device is also shown and is comprised of a back thin resonance chamber 530', having a back chamber wall formed by back support feature 520', is shown in communication with the back surface of transducer element 510 and containing back springy air 535'. (Back springy air 535' and other volumes and masses of air are more clearly depicted in FIG. 5*c*.) Further, a back output port 540', is shown in the back wall of the back thin resonance chamber 530' opposite piezoelectric transducer element 510. Mass air 545' inside the back output port 540' is excited in concert with the springy air 535' inside the chamber 540' to resonate at a back generated resonant frequency identical to, but out of phase with, resonant frequency of the front resonance chamber 530.

Further comprising backside elements and contiguous with back output port 540' is back transition chamber 550' which encloses a secondary springy air mass 555' to be captured within secondary chamber walls and between back output port 540' and back secondary output port 560'. Back secondary output port 560' is not a simple hole, but is rather formed by a gap between the back structural sound cap 566' and the back horn housing cup 564' and certain minor support legs 568' such as appear in section and partial section in FIG. 5*c*. Back horn housing cap 566' further includes surfaces which form the outer wall of the resonance chamber 530' and the inner and sidewalls of back transition chamber 550'. A companion barb holding mechanism 569' is depicted as a barb for its mating feature, recess holding mechanism 569. The air in the back output secondary port 560' is contiguous with air in the throat 572' of the back exit horn 570'. Sound entering region 574' freely travels to reflection plane 575' where it returns with forward velocity toward effective rear mouth 576' as a phase matched sound with that emanating from front port 540 at a region 576 in free air 90.

In the particular device of FIG. 5*b,* the various cross sectional conduits represent annular functional elements. Similarly the various connections between components such as the barb and recess holding mechanism 569' and 569; the cylinder 571' and star post 573' mechanism; and the stake 577' and socket 579' are present at intervals around the various annular placements in the assembly of piezoelectric whistle 500.

A variety of methods for electrically driving the transducer element 510 are well known, and in the present device, a circuit board 507 having an integrated circuit 509 supported by passive components 511 is shown mounted in the base 502 of the device. The electrical contact with the piezoelectric transducer element 510 is achieved by spring contactors 512 shown as cantilever extensions 514 of the spring contactors 512 proper which extend through contactor tunnels 518 passing from the chamber floor where it exists as a depression to the outer most margin of the structure of general purpose piezoelectric whistle 500 to be attached to an electrical driving circuit and power supply (neither of which is shown) external to the whistle structure.

FIGS. 6*a* to 6*d* demonstrate means for achieving an effective "line contact" method for positively holding a vibrating plate at a nodal point, which could also be an edge node. The various means, all shown in cross section, serve to permit rotation while minimizing translation at the support line for the vibrating element. The means shown in the various figures also provide for an effective sealing of the sound chamber.

FIG. 6*a* shows a front chamber structure 602 having an annular groove to support a compliant O-ring 620 on one side of vibration plate 610, and it uses a back chamber structure 604' which provides for an annular line contact opposite the other side of vibration plate 610, the front and back support annular contact lines being exactly opposite one another.

FIG. 6*b* shows a front chamber structure 602 having an annular groove to support a compliant O-ring 620 on one side of vibration plate 610, and it uses a similar back chamber structure 602' which provides for an annular line contact also achieved by an O-ring 620 opposite the other side of vibration plate 610, the front and back support annular contact lines being exactly opposite one another.

FIGS. 6*c* and 6*d* shows a front chamber structure 604 having a non-deformable annular line contact support on one side of vibration plate 610, and a similar back chamber structure 604' which provides for an annular line contact on the other side of vibration plate 610, the front and back support annular contact lines being exactly opposite one another. FIG. 6*d* additionally shows a hard mount 626 and a compliant member, O-ring 622 placed between said hard mount 626 and backside chamber structure 604'.

FIGS. 7*a* and 7*b* show details of contact means for bringing electrical power to a piezoelectric sound generator element such as element 10. FIG. 7*a* depicts a doubly cantilevered contact structure having a stem 702, a first cantilever section 704 and a second cantilever structure 706, which supports redundant contact points 708. FIG. 7*b* depicts a singly cantilevered contact structure having a stem 712, a first cantilever section 714 and a serpentine structure 716, which supports single arc-shaped contact point 718.

FIG. 8 shows details of a mechanical diaphragm useful in producing very energetic, short duration pulses or "clicks." The device comprises a single thin, elastic material diaphragm 810, which has a peripheral support edge 802 and a central driving pedestal 804. The plate is quasi-bi-stable, in that it will much more easily maintain a position at two extremes as shown in FIG. 8*a* and FIG. 8*b,* with very little to no sustaining force. It requires substantial force, relatively speaking, to maintain the plate at other positions between the tow extremes. An outer surround compliance feature 814 and an inner surround compliance feature 816 support central flex region 818.

Operational Principles of the Invention

In operation, the fundamental aspects of the invention can be most generally expressed in conjunction with the schematized pictorial descriptions of FIG. 1. Referring now to the cross sectional view of FIG. 1*b,* a mechanical vibration is caused to occur in transducer element 10 which in turn causes a compression and relaxation of contiguous springy air 35 inside resonance chamber 30. Springy air 35 is in continuous contact with mass air 45, and causes it to move as a more or less block back and forth in output port 40. It will be appreciated that the springy air 35 is only approximately equivalent to a spring, and mass air 45 is only approximately equivalent to a block mass in what is commonly referred to as a "lumped parameter" analysis of the system. The approximations are nonetheless adequate to describe the physics of the situation. The effect of the springy air 35 is to alternatively store and release energy as it is first compressed and then expanded in sympathy to the motion of transducer element 10. The effect of the mass air 45 is to alternatively store and release energy as the air is caused to attain velocity in one direction, stop, and then reverse itself. Whenever such mass and spring elements exist, the system that they form will attain a resonant frequency of operation, wherein the stored energy in the spring is exchanged for stored energy in the moving mass in a vibratory manner. The particular frequency where such exchange occurs optimally is referred to as the "natural frequency" or resonance of the system. The surface of the mass air 45, which is opposite springy air 35, is continuous with a spot of air in the environmental air 90. At this particular spot, energy is transferred from the mass air to the environmental air, and such energy, now referred to as acoustic energy, is free to propagate in all directions from the spot of its emanation.

The acoustic energy has itself both a pressure or potential energy component and a velocity or kinetic energy component as the energy propagates through the air. As the energy first emanates from the port 40, it has a considerable mass characteristic, i.e., it is very much like the air inside the port, i.e. "hard". The air surrounding the port is, in contrast, relatively "soft", and there is a mismatch in such air at the interface. The so-called hardness or softness of the air are degrees of an acoustic characteristic of the air commonly referred to as its acoustic impedance. Whenever the mismatch is severe, there is an inefficient transfer of energy between regions of harder or softer impedance, and useful acoustic energy is lost. An acoustic transformer, in the form of a horn 70 is used to minimize such loss of energy by allowing the hard air of the port 40 to transition in a predetermined smooth expansive fashion to the environmental air 90.

As explained earlier, springy air 35 and mass air 45 are only approximations of the behavior of the air contained in chamber 30 and port 40. In reality, the boundaries of the chamber and port can quite dramatically affect this assumption, and the system can fail to exist whenever certain compromises occur at the boundaries, particularly at the boundary of the port 40 to the environmental air 90. This can exist, for instance, when there is velocity in the environmental air itself. In order to minimize such effects and other similar effects which compromise the mass-spring behavior, a secondary acoustic element such as transition chamber 50 ase shown in FIG. 4*d* is sometimes required intermediate to the port 40 and the outside air 90. It will be appreciated that such intermediate elements are quite specific to the particular application in question.

The immediately preceding discussion describes how a simple plate and chamber alarm produces its sound to the environment, and it is clear that such sound can be generated from the active front surface of transducer element 10. However, as shown in FIG. 1*e,* an equivalent structure can be attached to the back surface of transducer element 10. The sounds emanating from the front horn 70 and the back horn 70' while being of identical frequency, will be exactly opposite in the timing of the pressure and relaxation parts of their energy transmission. Acoustically, a pressure or compression will be present at the horn mouth 76 exactly when a relaxation or rarefaction is present at horn mouth 76'.

The sound emanating from the respective horns can be made to add or subtract to any degree by the application of a conduit or conduits which prohibit the sounds generated from the respective surface to join in the environment 90. Such a delay conduit with a path length 80 is shown in FIG. 1*h.* In this instance, the sound generated by the back surface of transducer element 10 is caused to be delayed by a distance that is equal to one half of a wavelength of the resonant sound generated. By keeping the so generated sound from mixing in environmental air 90 with sound generated by the front surface of transducer element 10 until it has traveled this extra distance, the sound emerging from its horn will now be such that the sound energy at back horn mouth 76' will exactly the same frequency and phase as the sound emerging from the front horn mouth 76. The principle in practice will double the effective loudness of the device over a device similarly constructed but employing only one active surface of the transducer element 10.

It is very important that the system so constructed be designed for operation at one or at most a few related frequencies. The system will be very efficient whenever the various path lengths are chosen in ways that do not "spread" the effective resonance. In these devices, it is undesirable to seek any broadband response because such character rapidly decreases the effectiveness and efficiency of the sound generation. That is, broad bandwidth can only be attained at the sacrifice of efficient energy transfer at a single very narrow band system (or one that supports harmonics of such specific resonance.)

Certain operational aspects of the device are not peculiar to a two-sided whistle, but are important to the production of a practical device.

One so important operational consideration is in the mounting of the vibrating plate itself FIG. 6. In operation it is necessary for support of the vibration plate to be provided which permit a tight acoustical seal and also prevent translation of the support of the vibration disk while allowing it to rotate through such contact. Practically, it is difficult to achieve such holding, and a popular method has been to use a flexible adhesive such as a silicone RTV to hold the vibration element in place and to seal it. A more predictable solution, as demonstrated in FIGS. 6*a,* 6*b,* and 6*d* is the use of a compliant member to assure both the acoustic seal and an effective line support. In FIG. 6*a,* a hard line support on the backside of the disk is exactly opposite a compliant line contact formed by an O-ring 620. The O-ring 620, by permitting a relatively large amount of deformation compared to the manufacturing tolerances customary to the typical plastic structure, accommodates any manufacturing variation while achieving the desired acoustic and structural support requirements. FIG. 6*b* accomplishes the same end, but utilizes two O-rings 620. FIG. 6*c* demonstrates the use of two hard line contacts, which in theory would provide the necessary acoustic seal and line support. However, in practice, it is difficult to assure that stack up tolerances will allow such perfect contact, and FIG. 6*d* shows how the addition of a compliant member, a spring, or as shown an O-ring 622, through its deformation, can be used to assure appropriate contact of line edges of chambers 604 and 604' by compliantly accommodating any stack up tolerance between support 626 and chamber structure 604'

Yet another important operational feature is the manner in which electrical contact is made for example to a vibrating piezoelectric sound-generating element 10 of FIG 1. In operational practice, such electrical contact can be accomplished by attaching leads directly to the piezoelectric element, usually attaching such leads by wire bonding to the metallic structure or by soldering to the metallic structure and to a metalization that is bonded intimately with the piezoelectric ceramic or other piezoelectric material used in the construction of the vibration plate. Commonly, however, mechanical contact is made to the plate using spring-loaded contactors. The contactors in common practice typically have a single contact point, and the spring loading is accomplished either by coil springs around cylindrical contacts or by simple cantilever springs. An improvement on the general construction of the contacts is desirable which promotes redundant contact while minimizing the overloading of the contact point itself, which can fracture the typical ceramic piezoelectric material common to these applications.

Referring now to FIG. 7*a,* a doubly cantilevered spring contact is presented wherein its stem 702 forms a quasi immovable base for the first cantilever portion 704 which in turn supports second cantilever portions 706 which provides a basis for redundant contact points 708. In operation, such double cantilever structure provides for very consistent contact force over a relatively large range of deflection while assuring contact at two points, which oppose each other in a seesaw fashion.

Referring now to FIG. 7*b,* a singly cantilevered spring contact is presented wherein its stem 712 forms a quasi immovable base for the cantilever portion 714 which in turn supports a basis for single contact points 708, which in this instance is a circular arc whose tangency actually contacts the piezo element. In operation, Cantilever portion 714 is further enhanced in its providing nearly constant force over a wide range of deflection by means of serpentine 716.

Another important such operational consideration is that of a very efficient sound generating diaphragm such as might find use in car horns or other devices where substantial input energy is available and sound in the form of a regular series of highly energetic clicks is to be obtained. Such means is shown in FIG. 8, which in operation causes a displacement of central driving pedestal 804 to store a significant amount of elastic energy in outer surround compliance feature 814, in inner surround compliance feature 816 and in central flex region 818. With increasing displacement the energy continues to be stored up to the point where the displacement causes the entire diaphragm to become unstable as an upward directed member, and the stored energy then releases very rapidly move the structure into its secondarily downward directed position. The mechanism is familiar as the click created by a child's toy "cricket."

The foregoing description of preferred embodiments of the invention have been presented for purpose of illustration and description. It is not intended to be exhaustive nor to limit the invention to the precise form disclosed. Obvious modifications or variations are possible in light of the above teachings. The embodiments were chosen and described in order to best illustrate the principles of the invention and its practical applications to thereby enable one of ordinary skill in the art to best utilize the invention in various embodiments and with various modifications as are suited to the particular use contemplated. It is intended that the scope of the invention be defined by the claims appended hereto.

I claim:

1. A sound generating device comprising:

a first acoustic chamber;

a second acoustic chamber;

a plate interposed between the first and second acoustic chambers, the plate being capable of being vibrationally excited and operative to generate sound in the first and second acoustic chambers substantially only at a resonant frequency common to both the first and second chambers and/or harmonics of the resonant frequency, the sound in the first chamber having a phase difference from the sound in the second chamber; and a phase adjustment circuit for adjusting the relative phases of sound generated in the first and second chambers so as to emit sound into the environmental air at approximately the same phase.

2. A sound generating device as recited in claim 1 wherein the sound generated in the second acoustic chamber is 180 degrees out of phase with the sound generated in the first acoustic chamber.

3. A sound generating device as recited in claim 1 wherein the first and second acoustic chambers are identical in their construction.

4. A sound generating device as recited in claim 1 wherein the first and second acoustic chambers are not identical in their construction.

5. A sound generating device as recited in claim 1 wherein the phase delay circuit emits sound generated in the first and second chambers into the environmental air in generally the same direction.

6. A sound generating device as recited in claim 1 wherein the phase delay circuit emits sound generated in the first and second chambers into the environmental air at generally the same location.

7. A sound generating device as recited in claim 1 wherein the phase adjustment circuit adjusting includes a sound conduit of predetermined length and geometry.

8. A sound generating device as recited in claim 5 wherein the geometry of the sound conduit varies along the length of the sound conduit.

9. A sound generating device as recited in claim 5 wherein the geometry of the sound conduit diverges along the length of the conduit.

10. A sound generating device as recited in claim 6 wherein the geometry of the sound conduit varies along the length of the conduit.

11. A sound generating device as recited in claim 6 wherein the geometry of the sound conduit diverges along the length of the conduit.

12. A sound generating device as recited in claim 1 wherein the phase adjustment circuit is in the shape of an axially disposed folded horn.

13. A sound generating device as recited in claim 1 wherein the phase adjustment circuit is in the shape of a spiral horn.

14. A sound generating device as recited in claim 1 wherein the phase adjustment circuit is in the shape of a conduit comprising a first radial disposed portion followed serially by a second axial portion.

15. A sound generating device as recited in claim 1 wherein the phase adjustment circuit is in the shape of an open conduit in the form of a planar surface parallel to the sound wave emergent from the second acoustic chamber and at distance from the port in the second acoustic chamber such that the sound wave is reflected to travel approximately a half wavelength of sound to the point where it merges with the sound wave generated by the first resonance chamber.

16. A sound generating device comprising:

a first acoustic chamber;

a second acoustic chamber;

a plate interposed between the first and second acoustic chambers, the plate being capable of being vibrationally excited and operative to generate sound in the first and second acoustic chambers substantially only at a resonant frequency common to both the first and second chambers and/or harmonics of the resonant frequency, the sound in the first chamber having a phase difference from die sound in the second chamber;

at least one resonance stabilization circuit for stabilizing the resonating sound generated in the first and second chambers so as to maintain a resonant air column over a range of variably occurring conditions due to manufacturing, temperature, pressure and the like; and a phase adjustment circuit for adjusting the relative phases of sound generated in the first and second chambers so as to emit sound into the environmental air at approximately the same phase.

* * * * *